US007666126B2

(12) United States Patent
Rempe

(10) Patent No.: US 7,666,126 B2
(45) Date of Patent: Feb. 23, 2010

(54) BALANCING DEVICE AND METHOD

(76) Inventor: Douglas F. Rempe, 8185 Kemperridge Ct., Cincinnati, OH (US) 45249-2249

( * ) Notice: Subject to any disclaimer, the term of this patent is extended or adjusted under 35 U.S.C. 154(b) by 0 days.

(21) Appl. No.: 12/140,622

(22) Filed: Jun. 17, 2008

(65) Prior Publication Data

US 2009/0312165 A1 Dec. 17, 2009

(51) Int. Cl.
*A63B 26/00* (2006.01)

(52) U.S. Cl. ..... 482/143; 482/23; 482/121

(58) Field of Classification Search ..... 482/143–146, 482/34, 69, 77, 79, 121–130, 23, 33, 51, 482/78, 142
See application file for complete search history.

(56) References Cited

U.S. PATENT DOCUMENTS 3,765,674 A * 10/1973 Siler ..... 297/273
4,911,429 A * 3/1990 Ogbu ..... 472/119
4,966,364 A 10/1990 Eggenberger
5,328,421 A 7/1994 Stanalajczo
5,577,984 A * 11/1996 Bare, II ..... 482/43
5,704,882 A * 1/1998 Coates et al. ..... 482/69
6,017,297 A 1/2000 Collins
6,019,712 A 2/2000 Duncan
6,244,991 B1 6/2001 Bingham
6,554,747 B1 4/2003 Rempe
6,916,276 B1 7/2005 Robinson
6,942,487 B2 * 9/2005 Corbalis ..... 434/247
6,945,920 B1 9/2005 Kemery et al.
7,014,594 B2 * 3/2006 Stoltz ..... 482/24
7,090,621 B2 8/2006 Loane
7,090,628 B2 8/2006 Badarneh
7,137,938 B2 11/2006 Gottlieb
7,147,593 B2 12/2006 Vittone
7,288,055 B2 10/2007 Blaum
7,309,303 B1 * 12/2007 Proctor ..... 482/121
7,357,766 B2 4/2008 Langer et al.

OTHER PUBLICATIONS

Shuttle Balance, *Shuttle Systems* by Contemporary Design Company, www. shuttlesystems.com, (available to public prior to Jun. 17, 2007), 2 pages.

* cited by examiner

*Primary Examiner*—Lori Baker
(74) *Attorney, Agent, or Firm*—Hasse & Nesbitt LLC; Daniel F. Nesbitt

(57) ABSTRACT

A balancing device to assist a patient in exercising and rehabilitating balance. The balancing device includes a stationary support structure including an overhead support and a plurality of upright supports, and a suspended platform hanging from the overhead support by first and second suspending members. The platform is stabilized by at least two elastic supports having a first end attached proximate a portion of the periphery of the platform on opposite sides of the bisecting pivot line, and a second end attached to one of the plurality of upright supports. The patients standing on the platform can practice balancing and adjustments in a pivoting motion, and/or in ether a longitudinal and/or lateral direction.

11 Claims, 4 Drawing Sheets

BALANCING DEVICE AND METHOD

BACKGROUND OF THE INVENTION

Persons experiencing injuries or diseases that affect their movement and mobility can improve their condition and recovery using various balancing exercises. Typically balancing devices and practices involving pivoting on a ball or pivoting on a roller that is fixed to the floor. Such devices generally do not independently move either laterally (from side to side), or forward and back, or both, while also rocking, pivoting or rolling. This prevents the user from practicing or exercising their balance with natural-like movements.

SUMMARY OF THE INVENTION

The present invention provides a more functional balance board or platform that moves more like natural movement. This allows a person to practice activities in either a rehabilitative or training situation that would translate into a quicker recovery or learned activities. While typical balance boards are unstable surfaces that pivot around a fixed tilt point or line on the floor or ground, this balance board floats above the floor, allowing excursion in sagital, horizontal, and circumductive directions while still having a pivot point for control of vertical balance. The ability to stabilize while the board moves away from the upper body enhances core stabilization while providing a more natural loading of the lower extremities which is beneficial in rehabilitation and functional training.

The present invention provides a balancing device including: a stationary support structure including an overhead support and a plurality of upright supports; a suspended platform having a periphery and a bisecting pivot line, and having a first position and a second position on opposite sides of the platform proximate the periphery and along the bisecting pivot line; a first and second suspending members, each having a first and second end, each secured at the first end to the overhead support and at the second end to the platform at the first position and second position, respectively; and at least two elastic supports, each elastic support having a first end attached proximate a portion of the periphery of the platform on opposite sides of the bisecting pivot line, and a second end attached to one of the plurality of upright supports.

The present invention provides a balancing device including: a stationary support structure including an rectangular overhead support frame having four corners, and a plurality of upright support beams supporting the support frame at each of the four corners; a suspended rectangular platform having four corners and a periphery, and a bisecting pivot line dividing the rectangular platform into two rectangular portions, and having a first position and a second position on opposite sides of the platform proximate the periphery and along the bisecting pivot line; a first and second suspending cables, each having a first end and a second end, each secured at the first end to the overhead support and at the second end to the platform at the first position and second position, respectively; and at least two elastic supports, each elastic support having a first end attached proximate a portion of the periphery of the platform on opposite sides of the bisecting pivot line, and a second end attached to one of the plurality of upright supports.

The present invention also provides an element of a balancing device system, the elements selected from the group consisting of the stationary support structure described herein, and the suspended platform described herein.

DETAILED DESCRIPTION OF THE INVENTION

Figure 1:
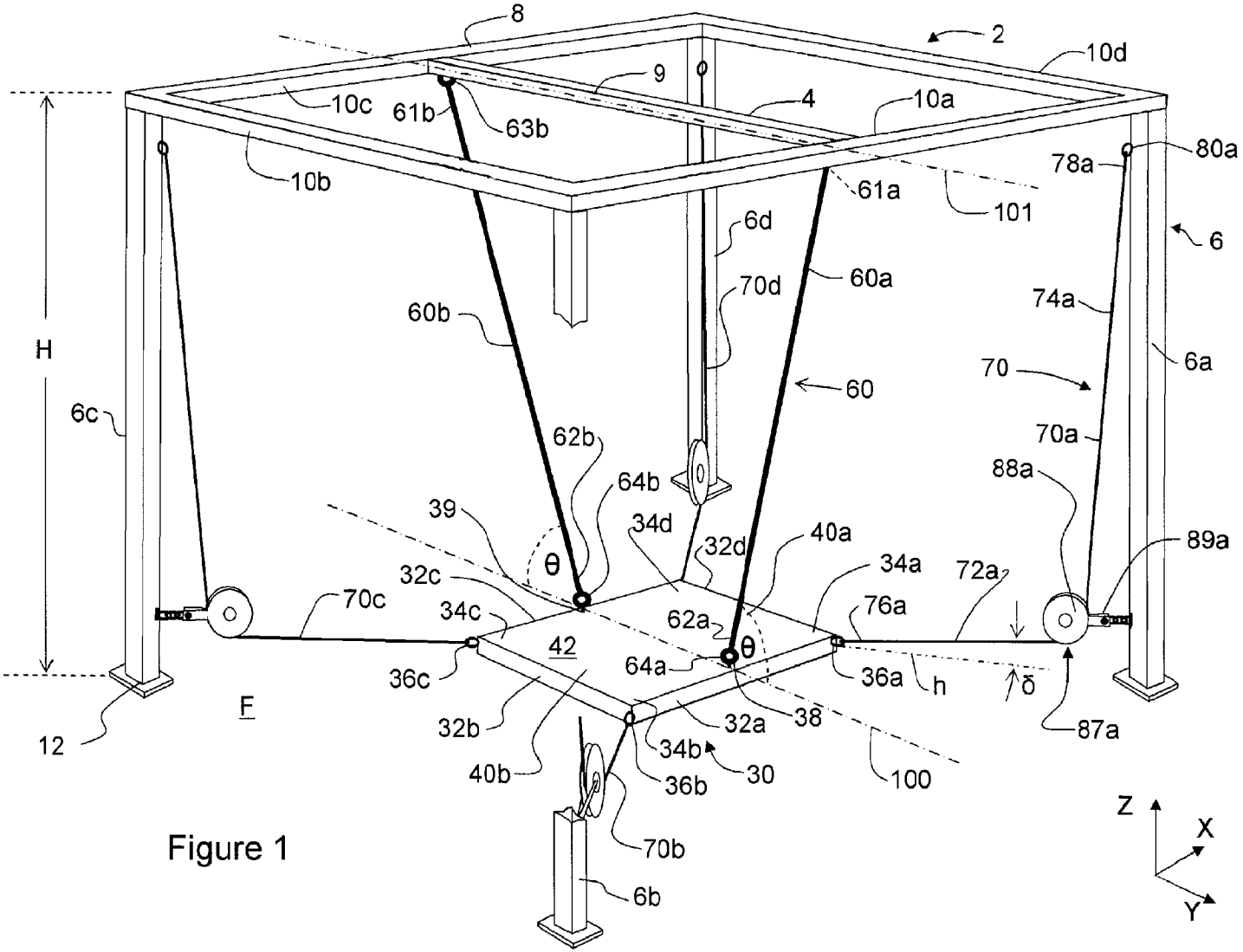
FIG. 1 shows a balancing device including a platform suspended from a stationary, overhead support, and elastic strands attached to the platform and extending to vertical supports with bases.

A suspended platform 30 is provided having a periphery defined by four sides 32*a*, 32*b*, 32*c* and 32*d*. Adjacent pairs of sides form corners 34*a*, 34*b*, 34*c* and 34*d*. The platform 30 is substantially bisected along a bisecting pivot line 100 into two sides 40*a* and 40*b* of substantially equal area and dimensions. A first securement, shown as a ring bolt 64*a*, is affixed at a first position 38 along the bisecting pivot line 100 proximate the front side 32*a*, and a second ring bolt 64*b* is affixed at a second position 39 along the bisecting pivot line 100 proximate the opposite rear side 32*c*

The suspended platform 30 is typically constructed of a wooden frame with a wooden upper surface 42, and is conveniently made in a square or rectangular shape. The typical size of the platform is about 0.5-1 meter wide, and about 0.5-1 meter in length. The platform can also be made of plastic, aluminum or other construction material. The platform is typically constructed so that its shape, size and weight are symmetrical about the bisecting pivot line 100. The ring bolts and other connector hardware mentioned below can be secured platform with screws, bolts and other well known means of attachment.

The platform 30 is suspended from a stationary support structure 2 that includes an overhead support 4 and a plurality of upright supports 6. In the illustrated embodiment, the overhead support 4 consists of a frame 8 formed by edge channels 10*a*, 10*b*, 10*c* and 10*d*, and a crossing channel 9 that spans between opposite edge channels 10*a* and 10*c* of the frame 8. The crossing channel 9 is positioned along longitudinal line 101. It can be understood that the overhead support can include a plurality of the crossing channels oriented in the same direction or in the cross direction from the longitudinal line 101, as well as in diagonal directions.

Figure 2:
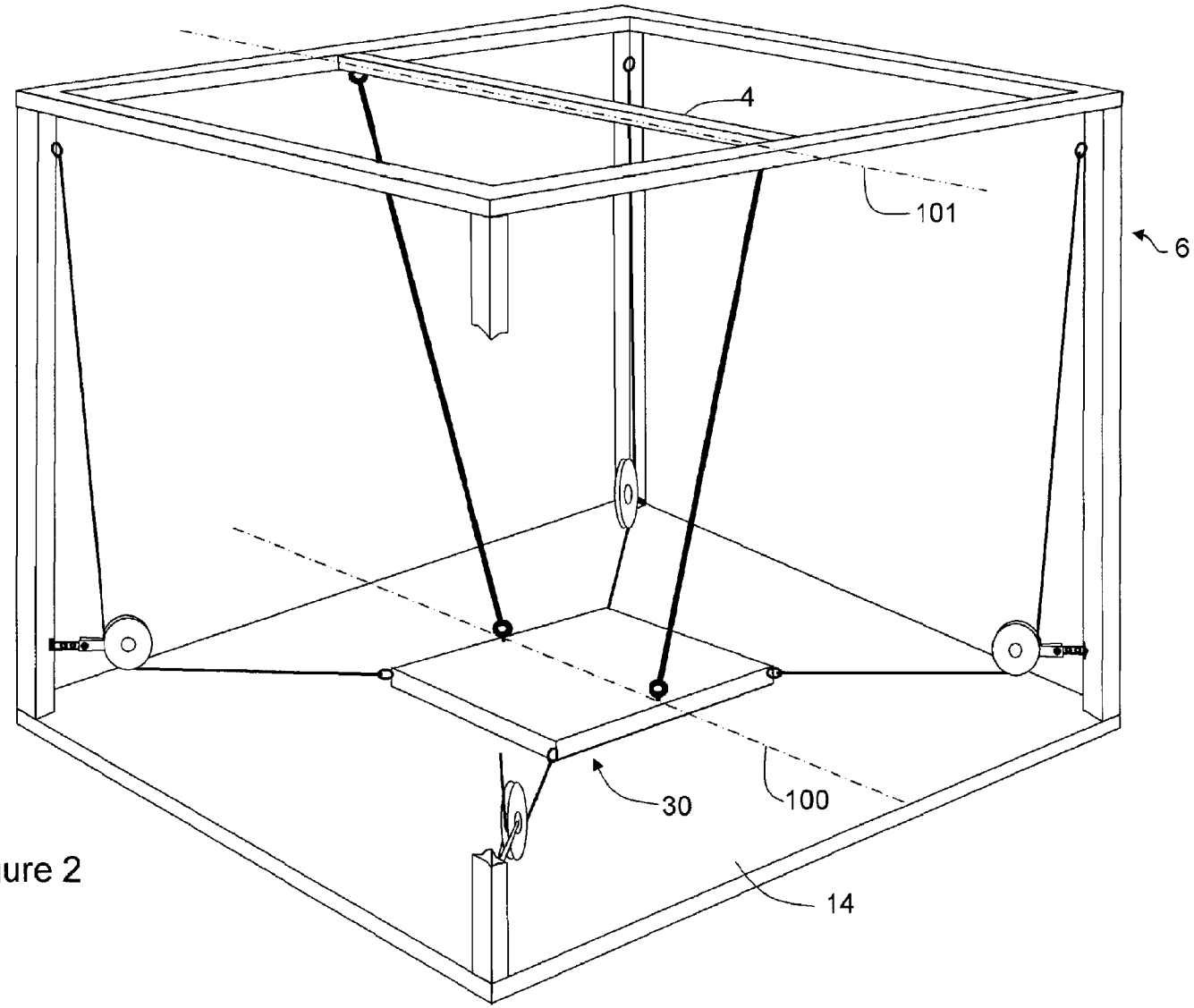
FIG. 2 shows the balancing device supported upon a base structure.

The upright supports 6 are channels or beams that generally extend vertically (in a z direction) down from and are positioned along the periphery of, the overhead support 4, to position the overhead support 4 at a height H well over the head of most standing adults, typically from about seven to eights feet from the floor F of the building in which the balancing device is used. The illustrated embodiment shows each upright support 6*a*, 6*b*, 6*c* and 6*d* positioned at a corner of the overhead support 4. The upright supports are typically spaced apart by several (3-5) feet from the platform, or about 6-8 feet apart from the adjacent support in a square or rectangular pattern. The upright supports 6 can be made with a base 12, or can be attached to a base structure 14 that has a separate floor 15, as shown in FIG. 2.

The stationary support structure 2 and its component overhead support 4 and upright supports 6 can be made of metal or wood, though steel and aluminum are preferred, and constructed by well known means including welding and fasteners, such as bolts, screws, slots and tabs, etc.

The platform 30 is suspended off of the floor by suspending members 60, each secured at one end 61 to the overhead support 4 and at the other end 62 to the platform 30 at the first position 38 and second position 39, respectively. Typically the platform is suspended about 1 to about 12 inches, more typically about 3-6 inches, off of the floor. The illustrated embodiment shows a pair of suspending members 60*a* and 60*b*. Suspending member 60*a* is secured at its first end 61*a* to a first securement, which is secured by bolting or screwing, to the crossing channel 9 proximate the edge channel 10*a* and along longitudinal line 101. A second suspending member 60*b* is secured at its first end 61*b* to a second securement, shown as ring bolt 63*b*, which is secured to the crossing channel 9 proximate the opposite edge channel 10*b* and along longitudinal line 101. The first platform securement is shown as a ring bolt 64*a*. A second suspending member 60*b* is secured at its first end 61*b* to a second securement, shown as ring bolt 63*b*, which is secured to the crossing channel 9 proximate the opposite edge channel 10*c* and along longitudinal line 101. Suspending members 60*a* and 60*b* are secured to the platform 30 at their second end 62*a* to the ring bolts 64*a* and 64*b*, respectively. The suspending member 60 is typically a non-extensive flexible member, which has a maximum length when elongated, but is also capable of being rolled up into a loop. A preferred suspending member 60 is a metal or plastic chain having a plurality of links of suitable size to bear the body weight of a person. The suspending member can have some elasticity or stretch; however, its primary purpose is to suspend the platform off of the floor when a patient ascends upon the platform. The chain can be affixed to the several ring bolt securements by well known means, such as a hook, a carabiner, a U-bolt, or other.

The suspended platform 30 resembles a playground swing. The platform 30 is capable of swinging laterally, from side to side in an ±x direction, perpendicular to the pivot line 100. That is, the bisecting pivot line 100 can swing in a tangential arc below the longitudinal line 101, in a ±y direction. Generally, the longitudinal line 101 is parallel to and above the bisecting pivot line 100. The platform 30 is also capable of swinging forward and backward along the axis of the bisecting pivot line 100 within a restricted distance. FIG. 1 shows that the suspending members 60 extend upward and forward from the ring bolts 64 at an angle θ, which is typically between 70° and 90°. The distance of forward swing becomes more restricted as the angle θ is reduced from 90°.

The platform is also fitted with at least two elastic supports 70. At least one each of the elastic supports is attached along the periphery on either side of the platform. More typically at least two elastic supports are attached along the periphery on either side of the platform. In the illustrated embodiment, there are four elastic supports 70*a*, 70*b*, 70*c*, and 70*d*. The elastic support 70*a* has a first end 76*a* attached proximate one of the corners of the platform to ring bolt 36*a* or equivalent. The opposite end 78*a* of the elastic support 70*a* is secured to the stationary support structure 2. In the illustrated embodiment, the opposite end 78*a* is secured along the length of the near upright support 6*a* to a ring bolt 80*a* or equivalent means, typically in the upper portion of the upright support 6*a*. The elastic support 70 is an elastic strand or rope, which is capable of being stretched along its length by application of a force. A typical elastic support is a bungee cord, which can consist of an elastic cord composed of one or more elastic strands forming a core, covered in a woven sheath usually of nylon or cotton. The bungee has a hook or requivalent means, secured to both ends of the elastic cord. A first portion 72*a* of the elastic strand 70*a* extends in a substantially horizontal direction from one of the corners of the platform 30 toward a pulley assembly 87*a* that is variably positioned and secured to a lower portion of the upright support 6*a*. A second portion 74*a* of the elastic strand 70*a* extends in a substantially vertical direction from the pulley assembly 87*a* toward the upper portion of the upright support 6*a*. The pulley assembly includes a rotating pulley wheel 88*a* and an extending arm 89*a* that is positionable along and secured to the upright support 6*a*. The vertical positioning of the pulley assembly 87 along upright support 6 defines an angle δ of the elastic strand extending from the platform 30, relative to horizontal "h". It can be understood that if the position of the pulley assembly is raised along the upright support, the angle δ will increase from horizontal "h".

In use, as the platform 30 pivots along centerline 100, a corner 34 of the platform 30 can raise, which decreases or makes negative the angle δ; or the corner can lower, which increases or makes positive the angle δ. The angle δ is typically between about −10° to about +30° from horizontal "h" when the platform is unloaded or at rest. The use of the pulley assembly allows a longer elastic strand to be used so that some of the elongation of the strand is taken up in the horizontal portion 72*a*, and the remaining elongation of the strand is taken up in the vertical portion 74*a*. The elastic strands 70*b*, 70*c*, and 70*d*, and pulley assemblies 87*b*, 87*c* and 87*d*, are typically similarly constructed and configured.

Figure 3:
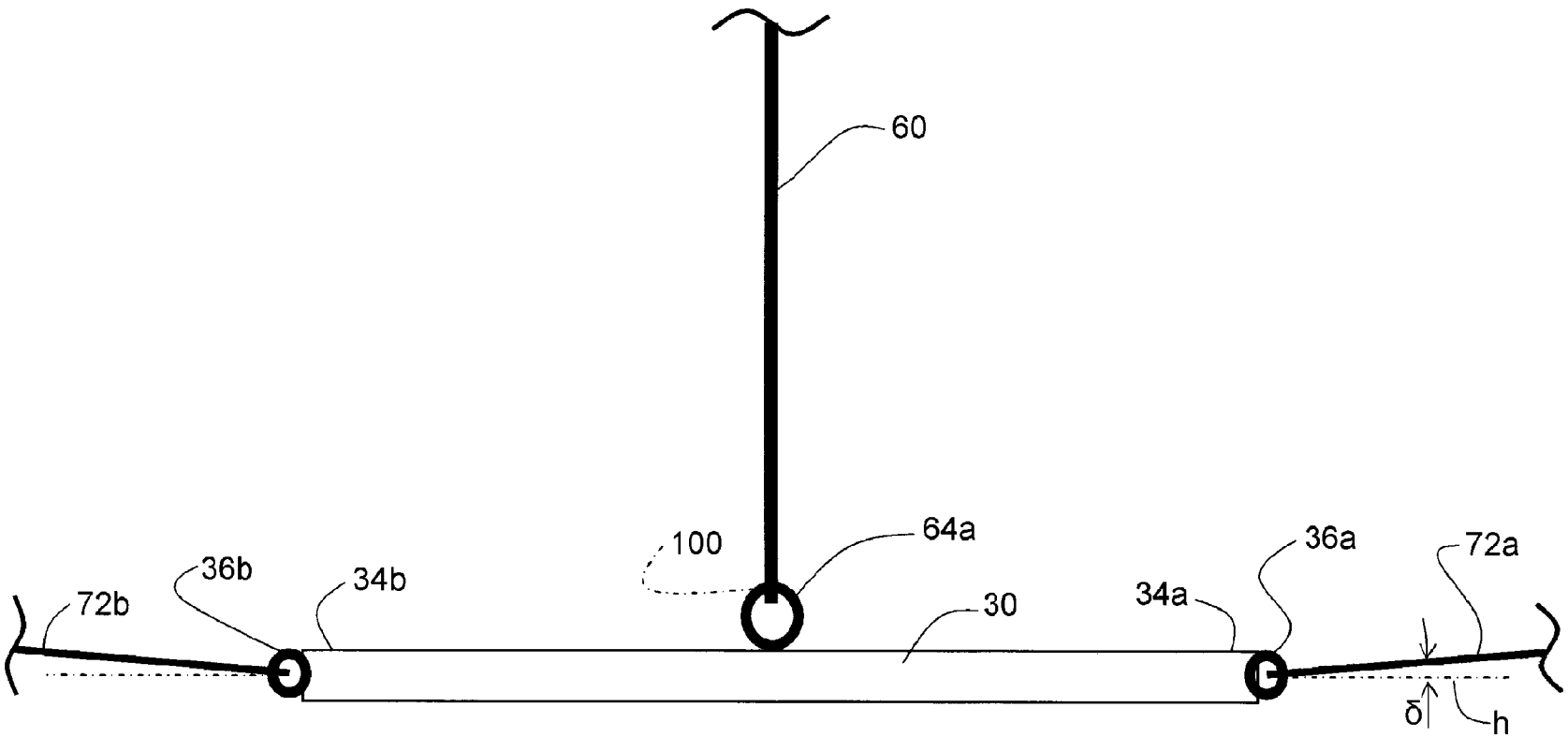
FIG. 3 shows a front elevation view of the platform in an unloaded condition.

The elastic strands 70 typically hold the platform 30 stationary when the platform is unloaded (the patient is not standing upon on it), as shown in FIG. 3. At the unloaded position, the elastic strands are typically adjusted in size and length to exert some force upon the corner of the platform in the upward and outward direction, and depending upon the positioning of the pulley assemblies, the elastic strands may lift the platform upward, allowing some slack to form in the suspending members 60.

Figure 4:
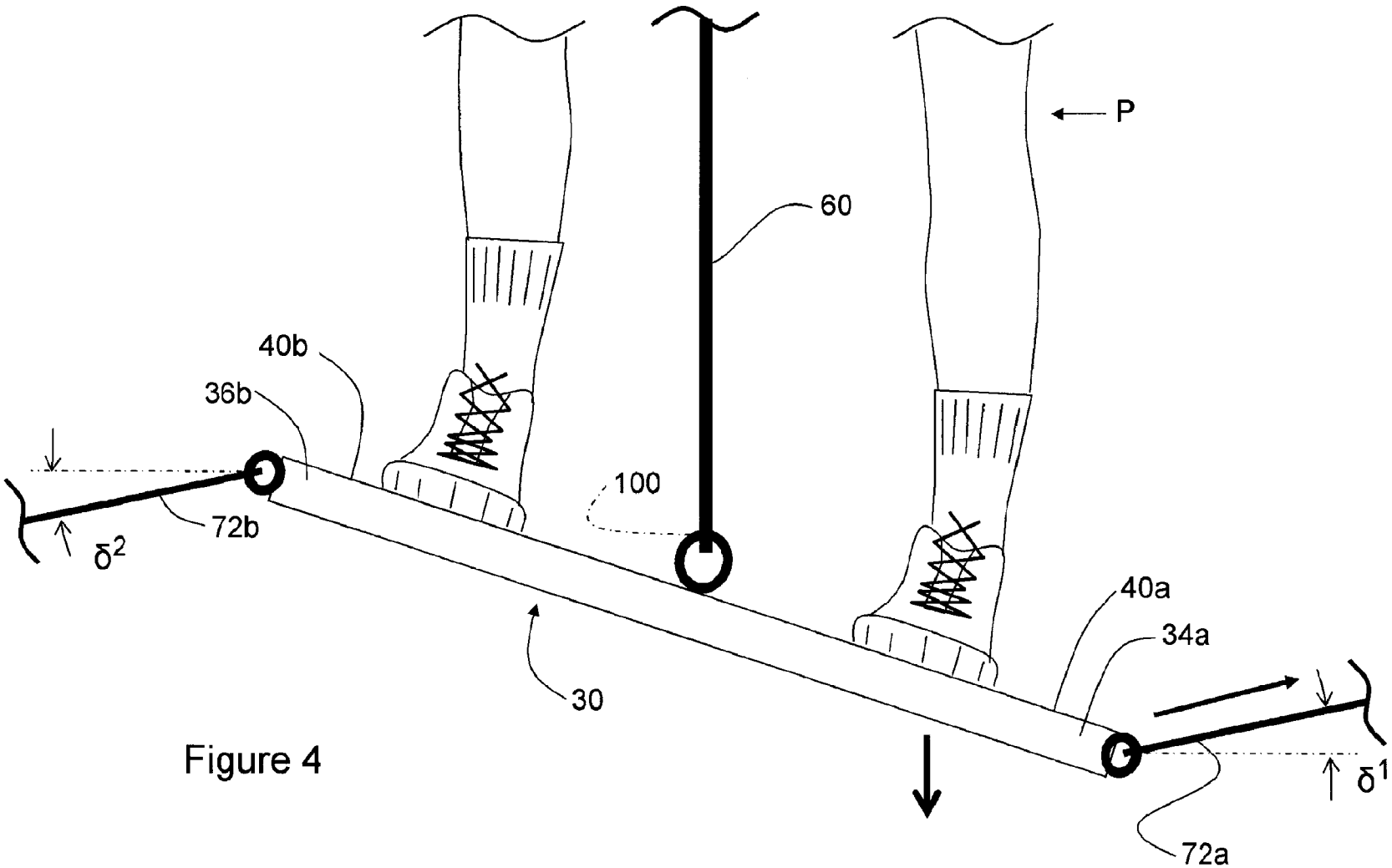
FIG. 4 shows the platform with a patient balancing on the platform.

When a patient P ascends onto the platform 30, the suspending members 60 become fully extended, and the elastic strands 70 exert lateral and vertical forces on the corners 34 of the platforms 30. As shown in FIG. 4, when the platform 30 is pivoted around the pivot line 100, such as by the shifting of the patient's weight, the downward movement of the right side 40*a* of the platform 30 increases the angle $\delta^1$ of strand portion 72*a* and elongates elastic strand 70*a*, which in turn exerts a force with both upward (vertical) and outward (in the lateral and/or longitudinal directions) force vectors upon the platform corner 34*a*, to assist the patient P to stabilize the platform. On the opposite side, the upward movement of the left side 40*b* of the platform 30 decreases, and typically makes negative, the angle $\delta^2$ of strand portion 72*b* and elongates elastic strand 70*b*, which in turn exerts a force with both downward and outward force vectors upon the platform corner 34*b*, again assisting the patient P to stabilize the platform. It is within the scope of the present invention for the technician or user to adjust the size or force factor of the elastic strands, the positioning of the pulley assembly along the vertical support 6, and the overall length of the elastic strands 70 to provide more or less resistive or assistive force upon the corners 34 of the platform 30 around the pivot line 100.

It can also be understood that the elastic strands cooperate to exert lateral and longitudinal resistive forces upon the platform 30 to also resist movement of platform 30 in the lateral and longitudinal directions, relative to the pivot line 100 when the platform 30 is at rest.

The device can provide independent movement of the platform laterally (from side to side) and forward and back, and both, while also allowing rocking and/or pivoting the platform.

METHOD OF THE INVENTION

The current invention can allow a person to stand on the platform and move either laterally, horizontally or a combination of both, while controlling vertical balance via the pivot point or pivot line. The patient can stand straddling the pivot point or line, bisecting the pivot point or in a variety of staggered positions which allows a variety of balance challenges. Activities like sitting or kneeling on the board can isolate more core muscles, allowing more unique challenges. Activities can be assisted via holding on the static vertical supports or by being supported by external elastic cords, or they can be resisted by having the elastic bands pulling downward from the overhead support. Increased challenges can be accomplished by having the patient or user balance without holding on to the supports, and squatting and moving the platform in a variety positions. The openness of the design allows for the individual to enhance multiple disciplines while balancing (including, catching a ball, reaching for targets, bumping a volleyball, lifting weights, and other activities.)

I claim:

1. A balancing device including: a stationary support structure including an overhead support and a plurality of upright supports; a suspended platform having a periphery and a bisecting pivot line, and having a first position and a second position on opposite sides of the platform proximate the periphery and along the bisecting pivot line; a first and second suspending members, each having a first and second end, each secured at the first end to the overhead support and at the second end to the platform at the first position and second position, respectively; and at least two elastic supports, each elastic support having a first end attached proximate a portion of the periphery of the platform on opposite sides of the bisecting pivot line, and a second end attached to one of the plurality of upright supports.

2. A balancing device including: a stationary support structure including an rectangular overhead support frame having four corners, and a plurality of upright support beams supporting the support frame at each of the four corners; a suspended rectangular platform having four corners and a periphery, and a bisecting pivot line dividing the rectangular platform into two rectangular portions, and having a first position and a second position on opposite sides of the platform proximate the periphery and along the bisecting pivot line; a first and second suspending cables, each having a first end and a second end, each secured at the first end to the overhead support and at the second end to the platform at the first position and second position, respectively; and at least two elastic supports, each elastic support having a first end attached proximate a portion of the periphery of the platform on opposite sides of the bisecting pivot line, and a second end attached to one of the plurality of upright supports.

3. The device according to claim 1, wherein the first and second suspending members are non-extensive flexible members.

4. The device according to claim 3, wherein the first and second suspending members are chains.

5. The device according to claim 3, wherein the first and second suspending members are cables.

6. The device according to claim 1, wherein the suspended platform is a substantially rectangular and substantially planar platform.

7. The device according to claim 6, wherein the suspended platform is rectangular and planar.

8. The device according to claim 1, wherein the at least two elastic supports extend from the platform at an angle $\delta$ from horizontal, wherein the $\delta$ angle is between about $-10°$ and about $+30°$ from horizontal when the platform is unloaded or at rest.

9. The device according to claim 2, wherein the first and second suspending cables are non-extensive flexible members.

10. The device according to claim 2, wherein the at least two elastic supports extend from the platform at an angle $\delta$ from horizontal, wherein the $\delta$ angle is between about $-10°$ and about $+30°$ from horizontal when the platform is unloaded or at rest.

11. A balancing device consisting of: a stationary support structure including an overhead support and a plurality of upright supports; a suspended platform having a periphery and a bisecting pivot line, and having a first position and a second position on opposite sides of the platform proximate the periphery and along the bisecting pivot line; a first and second non-extensive suspending members, each having a first and second end, each secured at the first end to the overhead support and at the second end to the platform at the first position and second position, respectively; and at least two elastic supports, each elastic support having a first end attached proximate a portion of the periphery of the platform on opposite sides of the bisecting pivot line, and a second end attached to one of the plurality of upright supports.

* * * * *

UNITED STATES PATENT AND TRADEMARK OFFICE

CERTIFICATE OF CORRECTION

PATENT NO. : 7,666,126 B2
APPLICATION NO. : 12/140622
DATED : February 23, 2010
INVENTOR(S) : Douglas F. Rempe It is certified that error appears in the above-identified patent and that said Letters Patent is hereby corrected as shown below:

Column 3, line 44, delete "70°" and insert --70 degrees--.
Column 3, line 44, delete "90°" and insert --90 degrees--.
Column 3, line 45, delete "90°" and insert --90 degrees--.
Column 4, line 9, delete "δ" and insert --phi ("δ")--.
Column 4, line 18, delete "-10°" and insert -- -10 degrees--.
Column 4, line 18, delete "+30°" and insert --+30 degrees--.
Column 5, Claim 1, line 1, after the words balancing device, insert --for assisting a person in exercising or rehabilitation--.
Column 5, Claim 2, line 1, after the words balancing device, insert --for assisting a person in exercising or rehabilitation--.
Column 6, Claim 8, line 2, delete "δ" and insert --phi--.
Column 6, Claim 8, line 3, delete "δ" and insert --phi--.
Column 6, Claim 8, line 3, delete "-10°" and insert -- -10 degrees--.
Column 6, Claim 8, line 4, delete "+30°" and insert --+30 degrees--.
Column 6, Claim 10, line 2, delete "δ" and insert --phi--.
Column 6, Claim 10, line 3, delete "δ" and insert --phi--.
Column 6, Claim 10, line 3, delete "-10°" and insert -- -10 degrees--.
Column 6, Claim 10, line 4, delete "+30°" and insert -- +30 degrees--.
Column 6, Claim 11, line 1, after the words balancing device, insert --for assisting a person in exercising or rehabilitation--.

Signed and Sealed this

Twenty-fifth Day of May, 2010

David J. Kappos

David J. Kappos
*Director of the United States Patent and Trademark Office*